US008322068B2

(12) United States Patent
Wilson

(10) Patent No.: US 8,322,068 B2
(45) Date of Patent: Dec. 4, 2012

(54) HOLDING DEVICE FOR RAIL EQUIPPED FIREARMS

(76) Inventor: John O. Wilson, El Cajon, CA (US)

( * ) Notice: Subject to any disclaimer, the term of this patent is extended or adjusted under 35 U.S.C. 154(b) by 57 days.

(21) Appl. No.: 13/006,349

(22) Filed: Jan. 13, 2011

(65) Prior Publication Data

US 2011/0173868 A1 Jul. 21, 2011

Related U.S. Application Data

(60) Provisional application No. 61/336,235, filed on Jan. 19, 2010.

(51) Int. Cl.
*F41A 29/00* (2006.01)
*F41C 27/00* (2006.01)

(52) U.S. Cl. ..... 42/95; 42/90; 73/167; 89/37.04

(58) Field of Classification Search ..... 42/94, 90, 42/95; 73/167; 89/37.04; 211/64
See application file for complete search history.

(56) References Cited

U.S. PATENT DOCUMENTS 4,548,392 A 10/1985 Rickling
4,807,381 A 2/1989 Southard
4,873,777 A 10/1989 Southard
4,998,944 A 3/1991 Lund
5,682,700 A 11/1997 Sandberg
5,833,102 A 11/1998 Jacobson
5,979,846 A 11/1999 Fluhr
6,761,101 B1 7/2004 Luth
D543,604 S 5/2007 Minneman
7,281,346 B1 10/2007 Cook et al.
7,584,690 B2 9/2009 Cauley
7,886,474 B2 * 2/2011 Werner ..... 42/94
7,900,390 B2 * 3/2011 Moody et al. ..... 42/72
7,980,017 B2 * 7/2011 Harman, III ..... 42/94
7,987,625 B1 * 8/2011 Moody et al. ..... 42/94
8,056,277 B2 * 11/2011 Griffin ..... 42/71.01
2009/0026679 A1 * 1/2009 Harman, III ..... 269/43
2009/0188146 A1 * 7/2009 Werner ..... 42/94

* cited by examiner

*Primary Examiner* — Michael David

(74) *Attorney, Agent, or Firm* — Stetina Brunda Garred & Brucker

(57) ABSTRACT

Provided is a gun mounting kit for quickly and easily mounting a gun in a position favorable for cleaning the gun. It is understood that guns may include mounting rails, such as a Picatinny-style rail or other similar mounting structures. The gun mounting kit includes a clamping unit that is sized and configured to clamp onto the mounting rail of the gun to secure the gun for cleaning.

14 Claims, 8 Drawing Sheets

HOLDING DEVICE FOR RAIL EQUIPPED FIREARMS

CROSS-REFERENCE TO RELATED APPLICATIONS

This application claims the benefit of U.S. Provisional Application No. 61/336,235, filed Jan. 19, 2010.

STATEMENT RE: FEDERALLY SPONSORED RESEARCH/DEVELOPMENT

Not Applicable

BACKGROUND

This application relates generally to a firearm holding device and more specifically to a clamping device for securely holding a firearm in a position that facilitates cleaning of the firearm.

It is well known that firearms require routine maintenance and repair. Traditionally, whenever such maintenance or repair was required, the firearm was held by hand or secured in some form of common mechanical vise. The vise mechanisms usually clamped or held the firearm on the barrel or butt stock or both, and if caution was not exercised, the vice mechanisms would not hold the firearm securely during bore cleaning or routine maintenance, or worse yet, would mar the firearm.

Another conventional form of holding device secures the firearm at the butt stock and supports the barrel and fore end at one or more longitudinal points along the firearm. This type of device will hold most fully assembled firearms for the relatively simple process of barrel cleaning, but is not readily adaptable for the task of cleaning and maintaining complex firearms that require the taking down and separating of the various firearm components.

Another type of firearm holding device used for the cleaning of firearms that fold or pivot at a pivot point, holds the firearm in the broken open position for cleaning of the barrel but does not allow access to the internal mechanical parts that must also be cleaned.

In the prior art, there are two widely used configurations of supports or cradles used for holding a firearm during the cleaning or maintenance operations. The predominant configuration includes a horizontal base or surface with two or more vertical members, wherein the firearm is held by the buttstock by one member and the forestock or barrel is held or supported by another member.

An inherent problem with the predominant configuration is that they are only functional with traditional firearms where the buttstock and barrel are attached in a manner that makes them a single unit. Firearms of this type do not require separation of the buttstock and barrel for complete cleaning or maintenance and therefore this type of support or cradle is not suitable for use with two-part, break-open firearms such as the M-16 or AR-15.

A second configuration includes a support or cradle that will hold a "break-open" or two part firearm where the two parts are still joined together at a hinge point. Such configurations typically include a firearm vise which holds a "break-open" or two part type firearm such as an AR-15 or M-16. When held in this manner, not all of the areas that require cleaning or maintenance are exposed to the operator. After using the type of firearm vise for cleaning or maintenance, the firearm is generally removed from the device and the two halves separated to complete the cleaning or maintenance recommended by the firearm manufacturers. Another disadvantage to this device is that if it is used on a traditional height bench, it is extremely difficult to clean the barrel in the preferred "breech to muzzle" direction due to the breech portion being positioned at a potentially awkward elevation.

Another device that is commonly used is a rifle cleaning cradle that relies on the firearm being held in a position by an elastic type bungee cord. While the bungee cord will hold the firearm to the cradle, the very nature of this elastic holding device will allow the firearm to move or shift during the cleaning of the firearm's barrel, which may make the cleaning process difficult. It also has the disadvantage of not exposing all areas which require cleaning or maintenance.

The above-described supports, vises and cradles rely on mechanisms that require the firearm to be held or clamped on surfaces which are unusual in shape and not readily gripped in a secure manner. These surfaces are typically not designed to accommodate mechanical holding forces required for secure and stable positioning.

In view of the foregoing, there is a need in the art for a device that will allow total access to the areas of a firearm that require cleaning or maintenance while at the same time holding the firearm in a secure and stable orientation.

BRIEF SUMMARY

According to one aspect of the present invention, there is provided a gun mounting kit for quickly and easily mounting a gun in a position favorable for cleaning the gun. It is understood that guns may include mounting rails, such as a Picatinny-style rail or other similar mounting structures. The gun mounting kit includes a clamping unit that is sized and configured to clamp onto the mounting rail of the gun to secure the gun for cleaning. The rail system or mounting structure provides a surface that is strong enough to accommodate mechanical holding forces required for secure and stable positioning during the cleaning process.

The gun mounting kit may include a first clamp body having a first engagement surface and a second clamp body attached to the first clamp body. The second clamp body includes a second engagement surface, wherein the first and second engagement surfaces collectively define a mounting groove sized to be cooperatively engageable with the Picatinny-style rail. The second clamp body is moveable relative to the first clamp body between a clamping position and a release position. The first engagement surface moves away from the second engagement surface as the first clamp body moves from the clamping position toward the release position, which in turn allows the rail to be removed from the mounting groove.

The first and second clamp bodies may collectively define a clamping unit that is configured for use with a barrel support. The barrel support may be disposed in spaced relation to the clamping unit to support a distal end portion of the gun barrel while the clamping unit engages with an opposed end portion of the gun.

In addition to the foregoing, it is expressly contemplated that other aspects of the present invention may relate to an adapter for use with a pistol-type gun having a magazine chamber. The adapter is configured to engage with the magazine chamber and the clamping unit to secure the pistol-type gun for cleaning. The adapter may include a magazine shaft sized and configured to be insertable into the magazine chamber, and a clamping beam coupled to the magazine shaft. The clamping beam is sized and configured to be engageable with the clamping unit.

It is also contemplated that further aspects of the present invention are directed toward accommodating a firearm wherein the rail mounting system is occupied by firearm components, such as a scope. Along these lines, an extension member may be provided that engages with the firearm at a location other than the mounting rail and extends from the firearm to engage with the clamping unit. As such, the extension member allows the components to remain mounted on the firearm while the firearm is cleaned.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
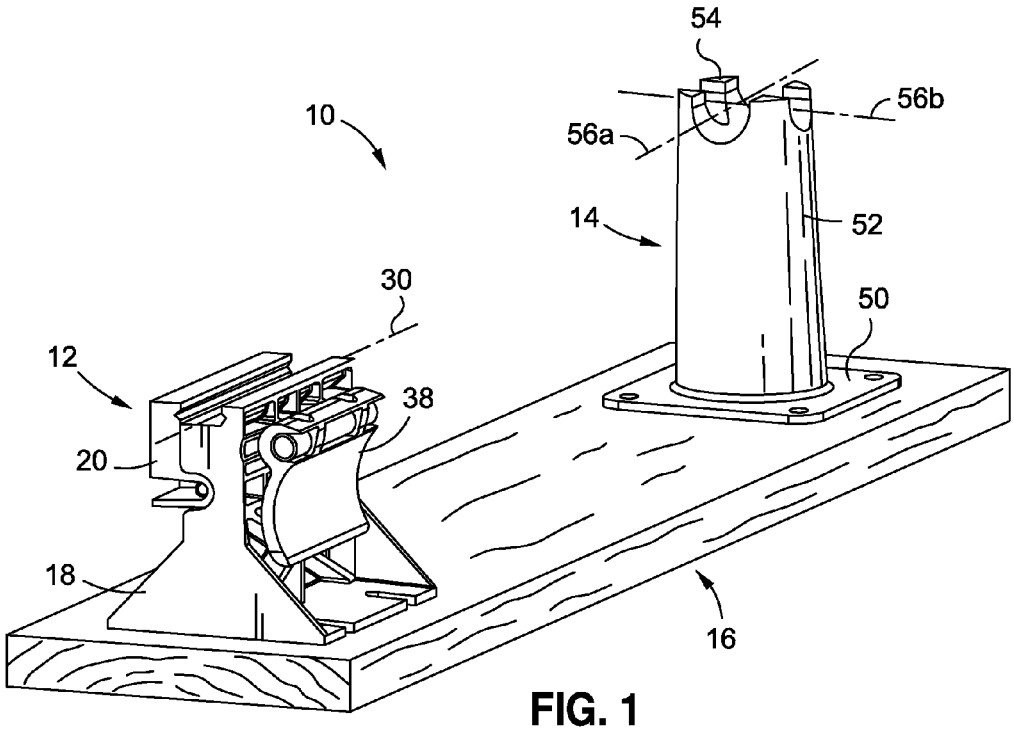
FIG. 1 is a first side upper perspective view of a gun mounting kit including a clamping unit and a barrel support.

Referring now to the drawings, wherein the showings are for purposes of illustrating preferred embodiments of the present invention, and not for purposes of limiting the same, there is shown a gun mounting kit 10 configured to secure a gun in a position for cleaning the gun. As used herein, the word "gun" may refer to rifles, pistols, handguns, shotguns, firearms, or other similar devices known by those skilled in the art. The gun mounting kit 10 includes a clamping unit 12 and a barrel support 14, both of which are mounted to a base 16. The clamping unit 12 is configured to engage with mounting rails, brackets, or other mounting structures commonly found on firearms to secure the firearm in a position which exposes all areas to be cleaned without requiring movement or shifting of the firearm. Furthermore, the gun mounting kit 10 may be adaptable for use with a wide range of firearms, rifles, pistols, etc. As such, a gun owner would only need one gun mounting kit 10 to clean several guns, i.e., the gun owner would not need a separate gun mounting kit 10 for each gun, or for each class of gun, such as rifles, pistols, handguns, etc.

Referring now to FIGS. 3-6, one embodiment of the clamping unit 12 includes a first clamp body 18 and a second clamp body 20. The first clamp body 18 and the second clamp body 20 collectively define an engagement surface defining a mounting groove 22 sized and configured to engage with the mounting structure on the firearm. The second clamp body 20 is transitional relative to the first clamp body 18 between a clamping position and a release position. In the clamping position, the first clamp body 18 and second clamp body 20 engage or clamp onto the mounting structure on the firearm disposed within the mounting groove 22 to secure the firearm in a cleaning position. As the second clamp body 20 is moved toward the release position, the first clamp body 18 and second clamp body 20 disengage from the mounting structure on the gun to allow the gun to be removed from the cleaning position.

The clamping unit 12 includes a front surface 24 defined by the first clamp body 18 and the second clamp body 20, and a rear surface 26, also defined by the first clamp body 18 and the second clamp body 20. A top surface 28 extends between the front surface 24 and the rear surface 26, and includes portions disposed on the first clamp body 18 and the second clamp body 20. The mounting groove 22 extends into the clamping unit 12 from the top surface 28 in a first direction, and extends between the front surface 24 and the rear surface 26 in a second direction to define a longitudinal groove axis 30.

Figure 3:
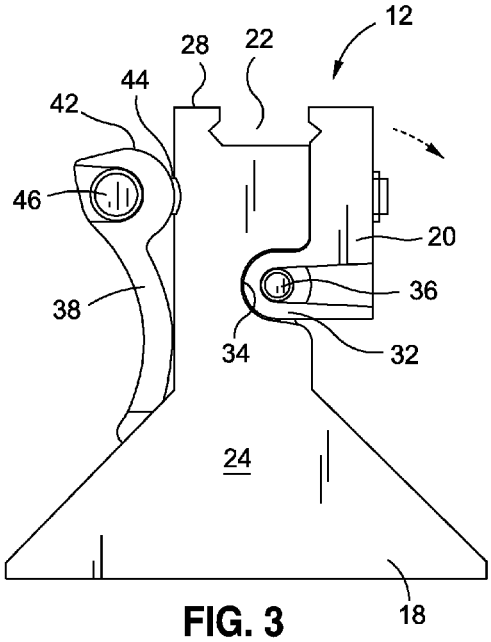
FIG. 3 is an front elevation view of the clamping unit having a first clamp body, a second clamp body pivotally connected to the first clamp body and a pivotable clamping handle.
Figure 4:
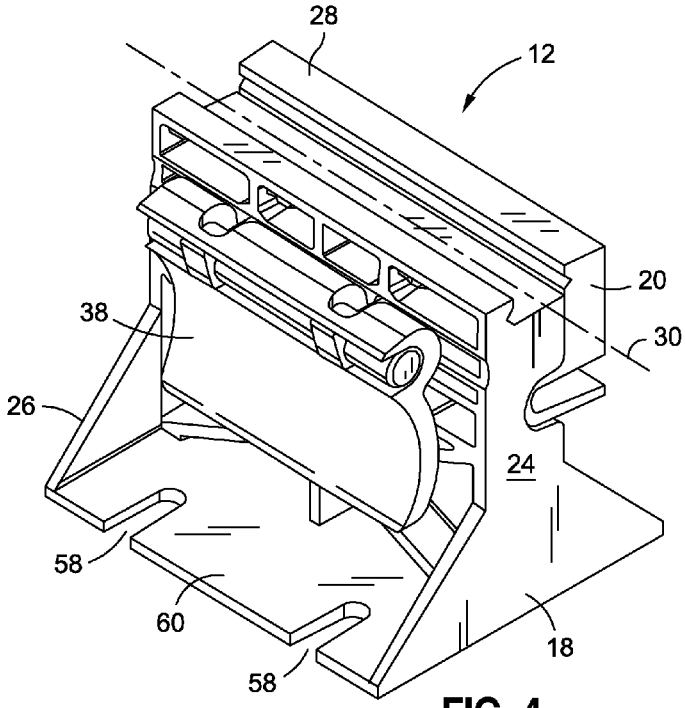
FIG. 4 is an upper perspective view of the clamping unit.
Figure 6:
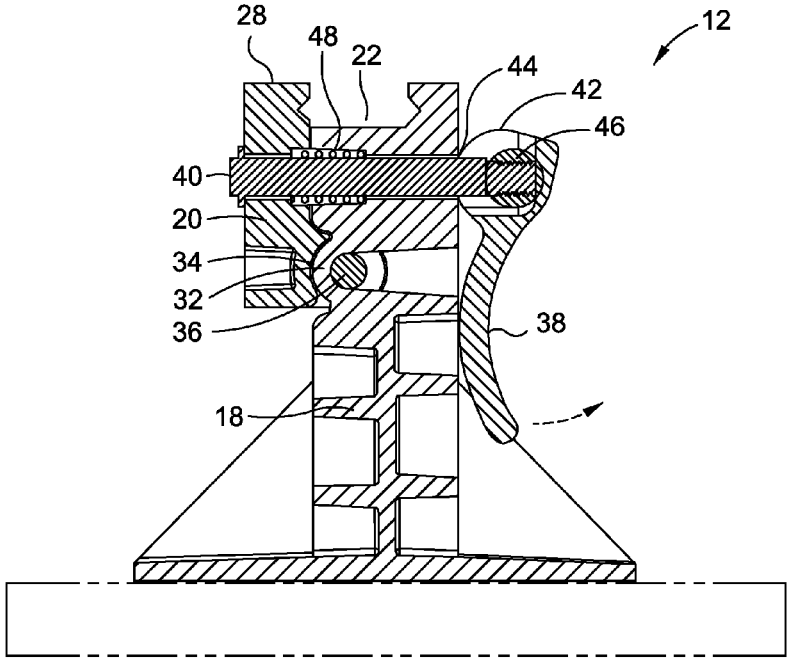
FIG. 6 is a rear sectional view of the clamping unit depicted in FIG. 5.

The mounting groove 22 defines a shape that is complementary to the mounting surface on the gun. Along these lines, many guns are equipped with Picatinny rail systems that conform to US MIL-STD-1913, or rail systems conforming to the Weaver rail profile. This profile is best illustrated in FIGS. 3 and 6, which show a transverse cross section of the mounting groove 22 in a direction perpendicular to a longitudinal groove axis 30. The profile includes a bottom surface that is spaced from and parallel to the top surface 28 of the clamping unit 12. A pair of opposed V-shaped indents are disposed between the bottom surface at the mounting groove 22 and the top surface 28.

In the embodiment depicted in the figures, the second clamp body 20 is pivotable relative to the first clamp body 18 between the clamping position and the release position, however, those skilled in the art will appreciate that other embodiments may include a second clamp body 20 that is translatable or otherwise moveable relative to the first clamp body 18. In the exemplary embodiment, the second clamp body 20 includes a pivot arm 32 and the first clamp body 18 defines a complementary pivot groove 34 sized to receive the pivot arm 32 of the second clamp body 20. The pivot arm 32 and the pivot groove 34 are sized and configured to allow the second clamp body 20 to pivot between the clamping position and the release position. A pivot pin 36 extends through the first clamp body 18 and second clamp body 20 to connect the second clamp body 20 to the first clamp body 18, and to allow the second clamp body 20 to pivot about the pivot pin 36.

According to one embodiment, movement of the second clamp body 20 relative to the first clamp body 18 is controlled by a clamping handle 38. The clamping handle 38 is moveable relative to the first and second clamp bodies 18, 20 to control movement of the second clamp body 20 relative to the first clamp body 18. In this regard, the clamping handle 38 is moveable between a handle clamp position, wherein the second clamp body 20 is disposed in the clamping position, and a handle release position, wherein the second clamp body 20 is disposed in the release position. Movement of the clamping handle 38 from the handle clamp position toward the handle release position results in movement of the second clamp body 20 from the clamping position toward the release position.

Referring now to FIG. 6, which shows a sectional view of the clamping unit 12, a connecting pin 40 connects the clamping handle 38 to the first and second clamp bodies 18, 20. The clamping handle 38 further includes a cam portion 42 that engages with a handle engagement surface 44 defined by the first clamp body 18. A handle pivot pin 46 (see FIG. 3) extends through the clamping handle 38 and engages with the connecting pin 40, as shown in FIG. 6. An internal spring 48 is disposed between the first clamp body 18 and the second clamp body 20, as well as being disposed about the connecting pin 40. The internal spring 48 urges the second clamp body 20 toward the release position. Accordingly, the handle 38 and connecting pin 40 are configured to overcome the biasing force applied by the spring 48 to selectively move the second clamp body 20 from the release position toward the clamping position.

The first clamp body 18 and the second clamp body 20 both include a connecting slot sized and configured to receive the connecting pin 40. When the second clamp body 20 is connected to the first clamp body 18, the connecting slots are coaxially aligned to allow the connecting pin 40 to extend therethrough. A portion of the connecting slot extending between the first clamp body 18 and the second clamp body 20 is enlarged to accommodate the internal spring 48.

As shown FIG. 6, the clamping handle 38 is in the handle clamped position, and the second clamp body 20 is in the clamping position. To move the second clamp body 20 toward the release position, the clamping handle 38 is moved relative to the first clamp body 18 in an upward, counterclockwise direction, which effectuates translation of the connecting pin 40 through the connecting slot. As the connecting pin 40 translates, the spring 48 urges the second clamp body 20 toward the release position. To move the second clamp body 20 back to the clamped position, the clamping handle 38 is moved downwardly in a clockwise direction, which causes the connecting pin 40 to translate in an opposite direction, to pull the second clamp body 20 toward the clamping position.

Figure 2:
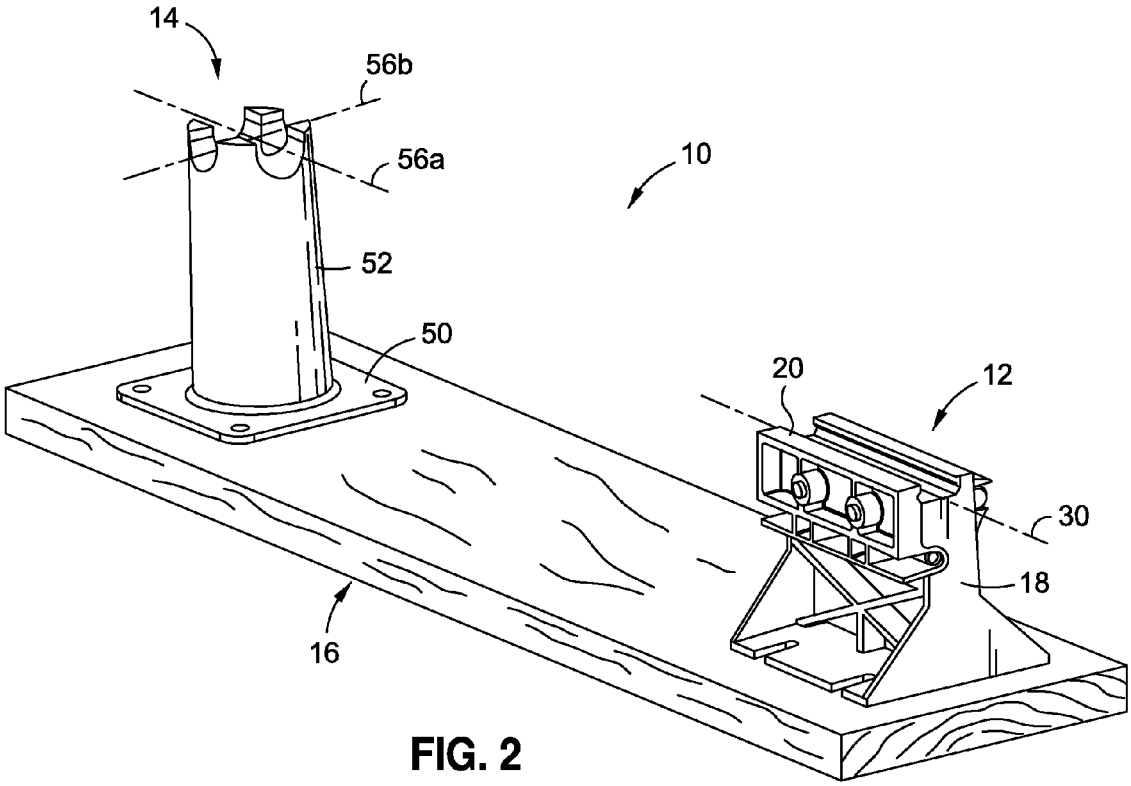
FIG. 2 is a second side upper perspective view of the gun mounting kit depicted in FIG. 1.

Referring now back to FIGS. 1 and 2, the gun mounting kit 10 also includes a barrel support 14 for use in connection with the clamping unit 12. The barrel support 14 is configured to engage with the barrel portion of the gun clamped within the clamping unit 12. Those skilled in the art will appreciate that the barrel support 14 may not be required for guns having small barrels, such as hand pistols.

Figure 5:
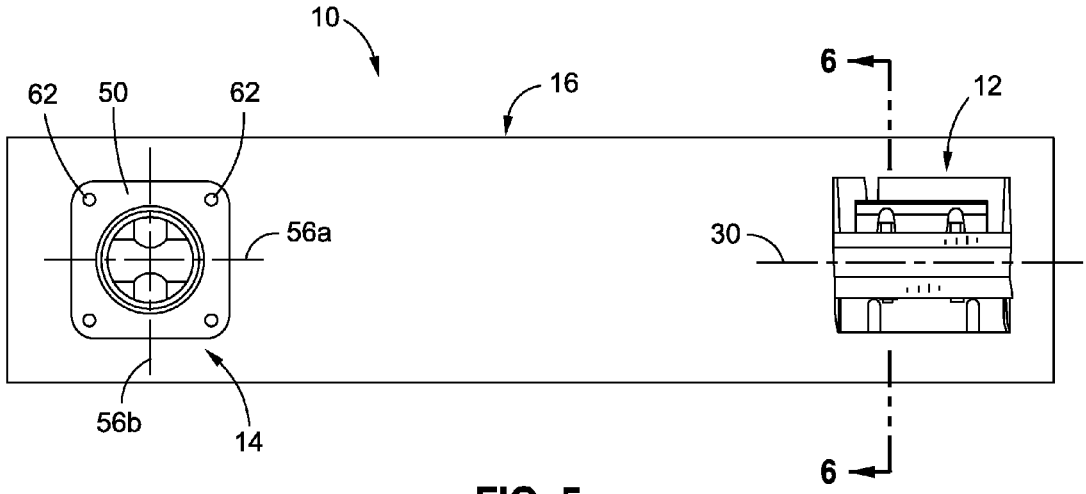
FIG. 5 is a top view of the gun mounting kit shown in FIGS. 1 and 2.

The barrel support 14 includes a support base 50 and a support body 52 extending from the support base 50. The support body 52 defines a distal end 54 disposed opposite the support base 50. One or more support grooves may be formed within the support body 52, with the support grooves extending into the support body 52 from the distal end 54. In the embodiment shown in FIGS. 1 and 2, the barrel support 14 includes a pair of U-shaped support grooves found therein. Each support groove extends along the support groove axis, as is best shown in FIG. 5.

The barrel support 14 is disposed in spaced relation to the clamping unit 12, such that one of the support groove axes 56*a*, 56*b* is aligned with the longitudinal groove axis 30 defined by the mounting groove 22. Mechanical fasteners may be used to secure the clamping unit 12 and barrel support 14 upon the base 16 in a desired position. Along these lines, the clamping unit 12 may include cutouts 58 formed within the bottom plate 60, wherein the cutouts 58 receive a mechanical fastener for securing the clamping unit 12 to the base 16. For instance, a screw or bolt may extend out of the base 16 and into cutout 58, such that a nut may be threadably secured to the screw or bolt to fasten the clamping unit 12 to the base 16. Likewise, the barrel support 14 may include cutouts 62 formed within the support base 50 for securing the barrel support 14 to the base 16.

Figure 7:
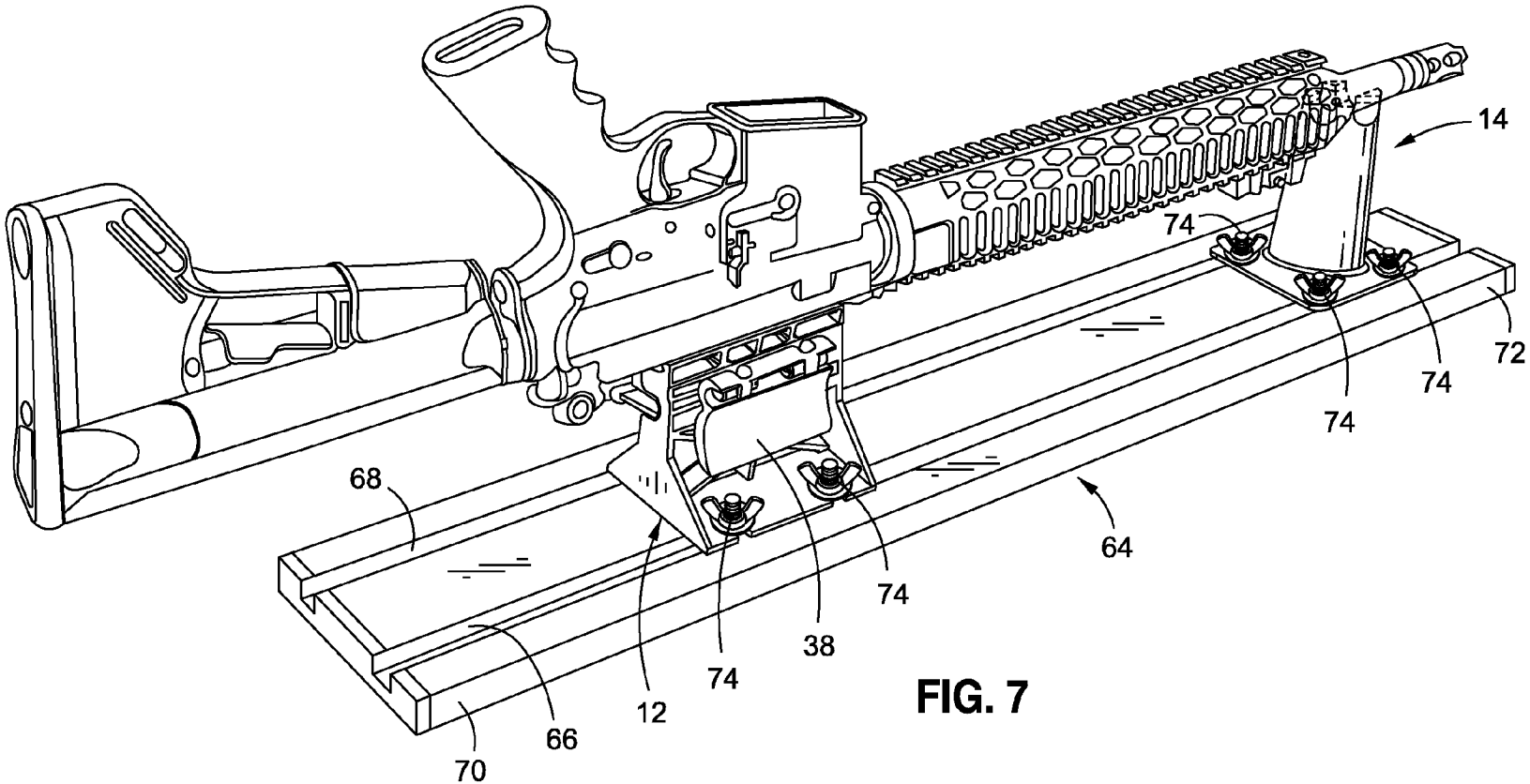
FIG. 7 is an upper perspective view of the gun mounting kit with a gun mounted thereto.

Referring now to FIG. 7, there is shown a base 64 having a pair of parallel grooves 66, 68 formed therein, wherein the grooves 66, 68 extend longitudinally along the base 64 between a first end portion 70 and an opposing second end portion 72. The grooves 66, 68 may be sized and configured to accommodate mechanical fasteners 74 for securing the clamping unit 12 and the barrel support 14 to the base 64. The mechanical fasteners 74 are translatable along the grooves 66, 68 to selectively position the clamping unit 12 and barrel support 14 relative to the base 64.

Figure 8:
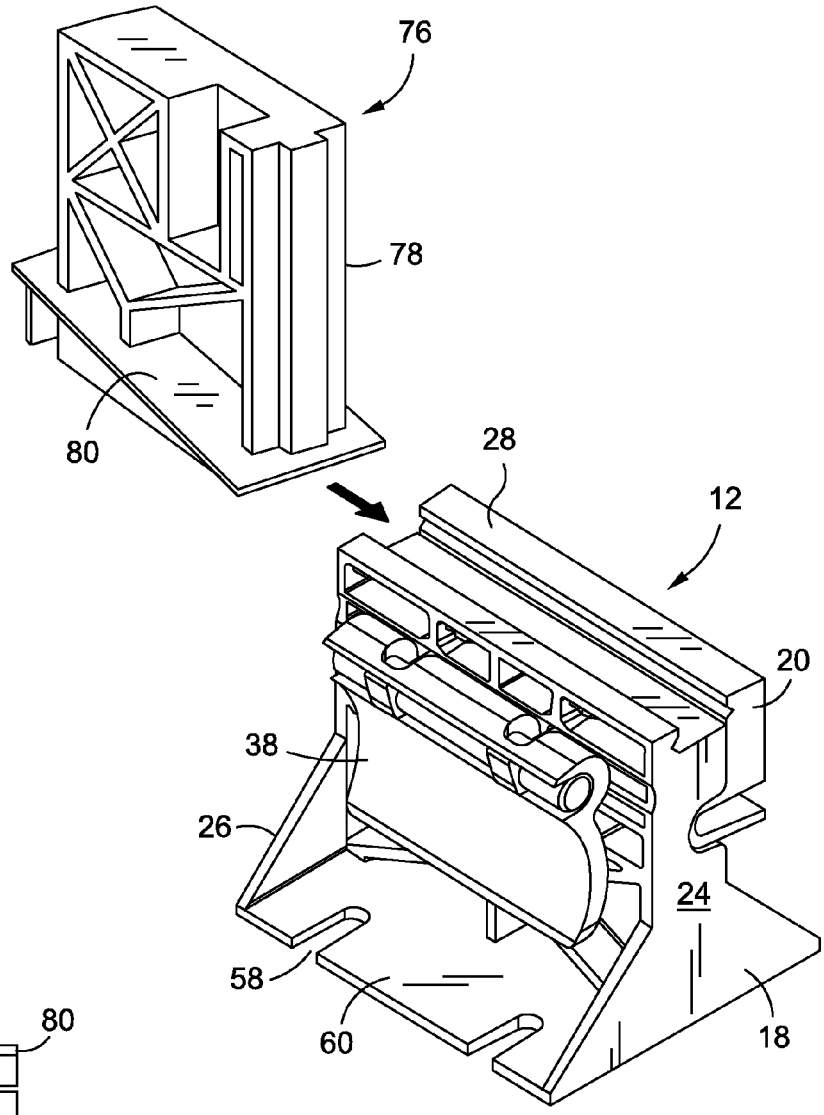
FIG. 8 is an upper perspective view of an adapter and the clamping unit.
Figure 9:
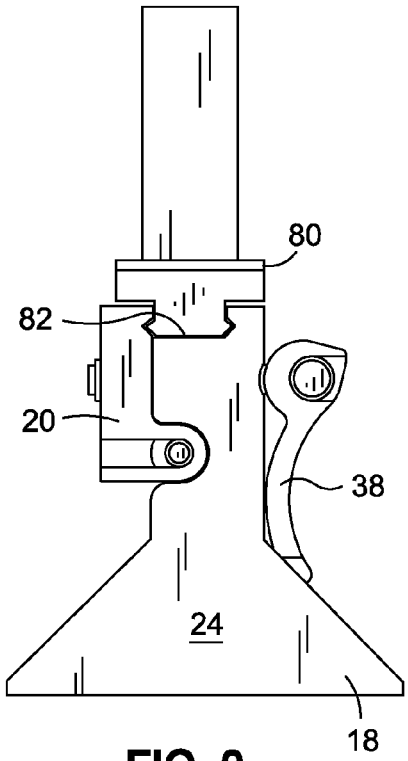
FIG. 9 is a rear view of the adapter engaged with the clamping unit.
Figure 10:
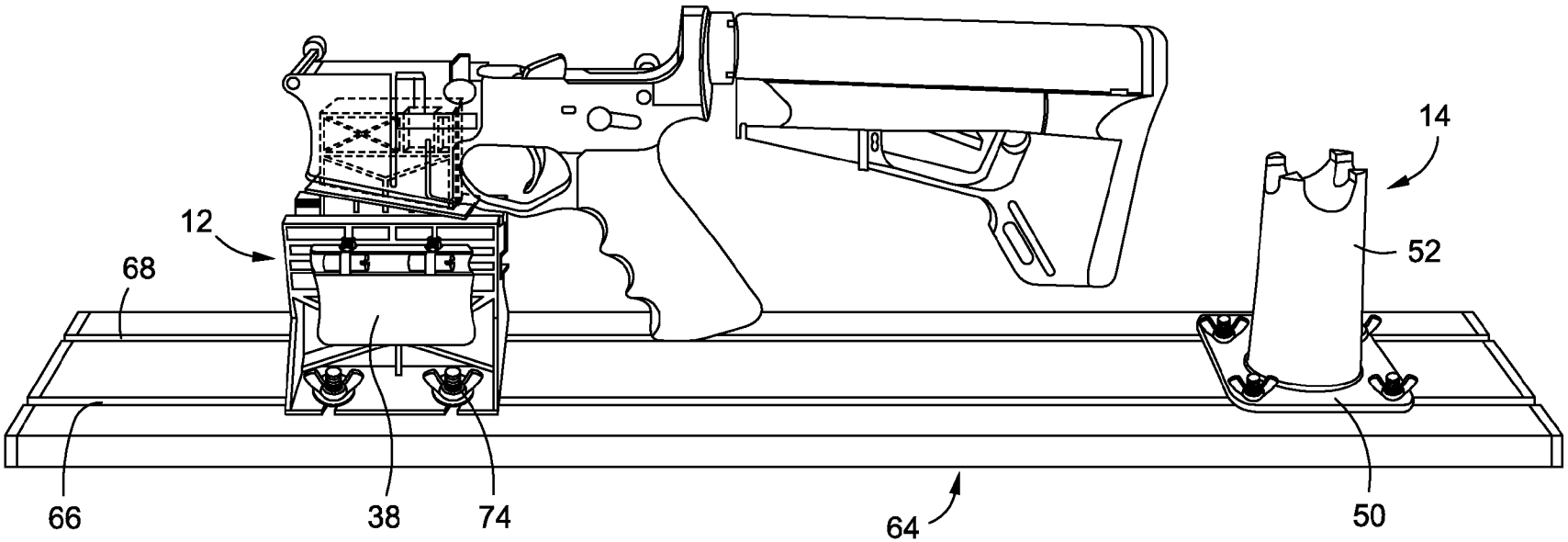
FIG. 10 is a first side upper perspective view of a firearm engaged with the adapter and the clamping unit.

The foregoing discussion describes the clamping unit 12 as being configured to directly engage with a portion of the guns, such as Picatinny style rail system. However, those skilled in the art will appreciate that various attachments may be connected to the rail system, which may restrict engagement with the clamping unit 12. Furthermore, certain guns may not be equipped with a rail system. Therefore, various aspects of the present invention are directed toward an adaptor for adapting firearms that do not have a readily available connecting portion for use with the clamping unit 12. Reference is now made to FIGS. 8-10 which shows an adaptor 76 used with the clamping unit 12. The adaptor 76 is sized and configured to fit within the magazine well of the firearm. In the embodiment shown in FIGS. 8 and 9, the adaptor 76 is specifically configured to fit all AR-15 style rifles (5.56 mm). More specifically, the adaptor 76 includes a magazine portion 78 that is complementary in shape to the magazine well defined by the firearm. An abutment flange 80 extends around the magazine portion 78 and is configured to be disposed in abutting relation with the firearm when the magazine portion 78 is fully inserted within the magazine well. The adaptor 76 further includes a clamping portion 82 that is sized to be received within the mounting groove 22. In this regard, the clamping portion 82 is similar in shape to the mounting rails on the firearms.

Figure 11:
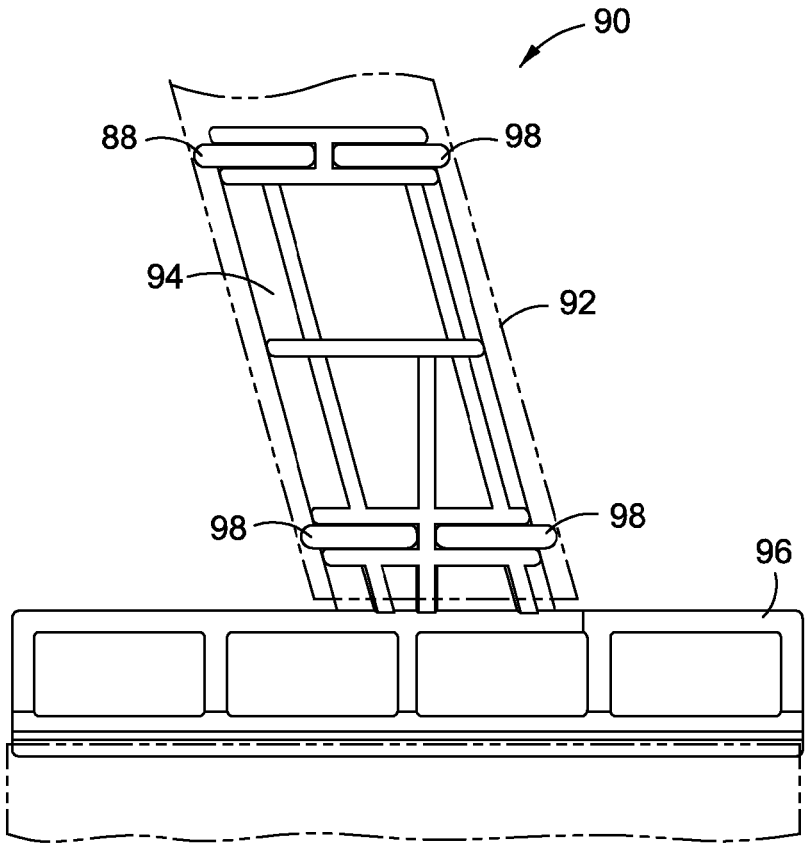
FIG. 11 is a side view of an adapter for a pistol having a magazine chamber.
Figure 12:
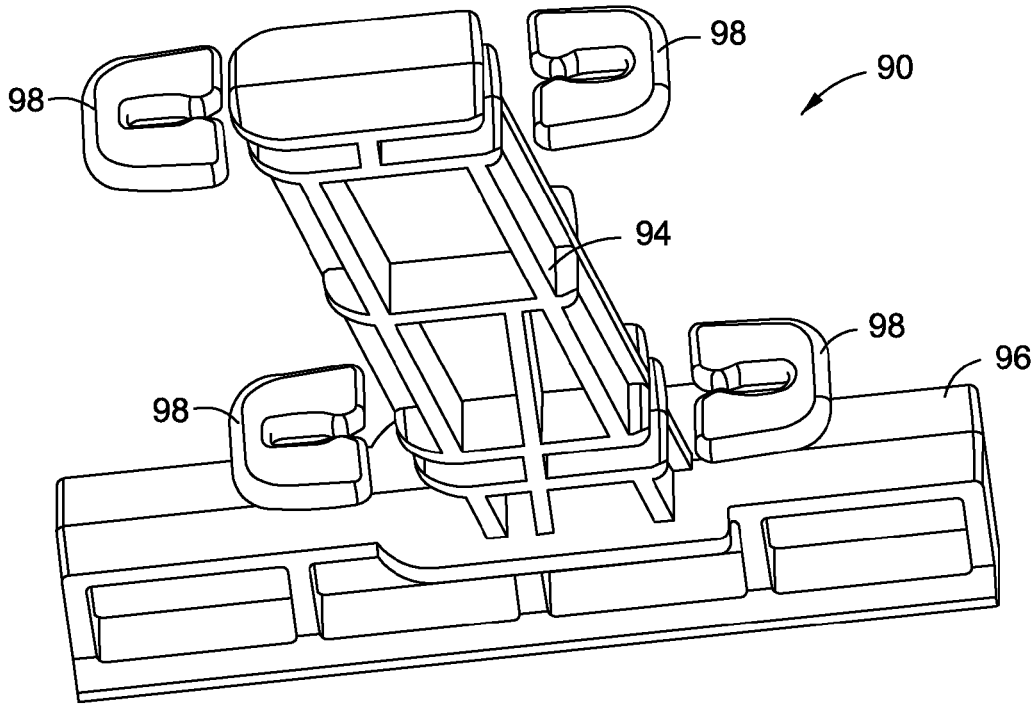
FIG. 12 is an exploded upper perspective view of the adapter depicted in FIG. 11.

Referring now to FIGS. 11 and 12, there is shown an adapter 90 for use with securing a pistol to the clamping unit 12. In general, the handle portion 92 of the pistol includes a magazine well for receiving a magazine loaded with ammunition. The adapter 90 is configured to be insertable within the magazine well (when the magazine is removed therefrom) to connect with the pistol. As shown, the adapter 90 includes a magazine shaft 94 sized and configured to be insertable into the magazine well. The magazine shaft 94 is connected to a clamping beam 96, which is sized and configured to engage with the clamping unit 12. In this regard, the clamping beam 96 may define a shape that is complimentary to the mounting groove 22 of the clamping unit 12. In other words, the shape of the clamping beam 96 may be similar to the Picatinny rail, or other mounting structure discussed above. Furthermore, the clamping beam 96 may be engaged with the clamping unit 12 in a manner similar to the mounting structures discussed above.

Those skilled in the art will appreciate that the size of the magazine well may vary from gun to gun. Therefore, one embodiment of the adapter 90 includes magazine shaft adjustment clips 98 to adjust the size of the magazine shaft 94 to conform to the size of the magazine well of the pistol. The magazine shaft 94 may include a plurality of clip grooves within which the clips 98 may be inserted. The clips 98 are configured to frictionally engage with the magazine shaft 94 when pressed onto the magazine shaft 94. When the clips 98 are placed on the magazine shaft 94, the magazine shaft 94 engages with the inner wall of the magazine well to connect the gun to the adapter 90 (See FIG. 11).

Figure 13:
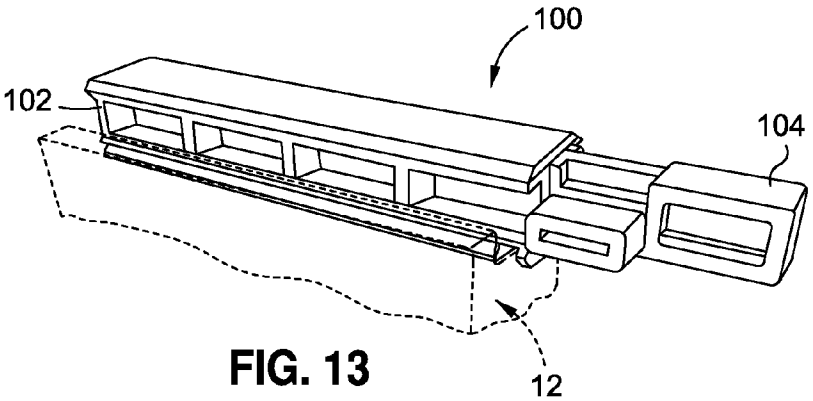
FIG. 13 is an upper perspective view of an extension member.
Figure 14:
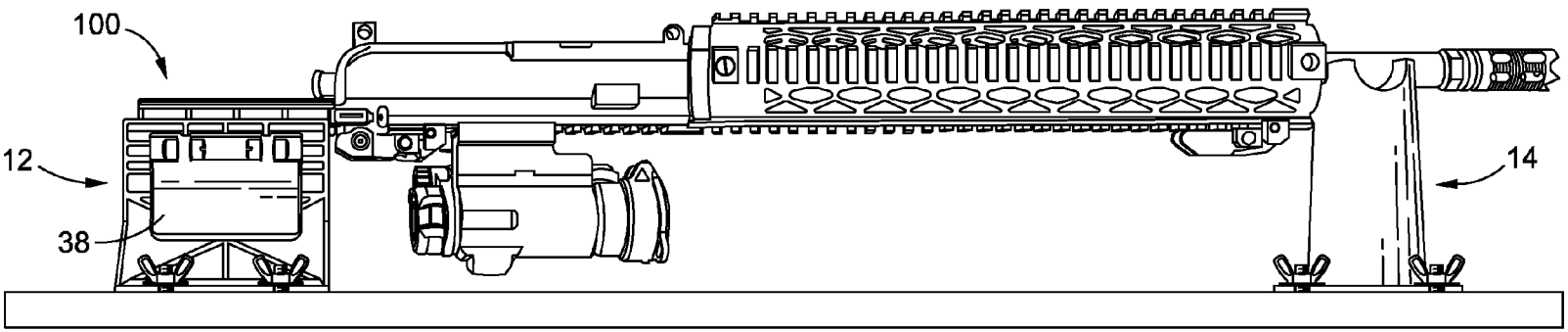
FIG. 14 is a side view of the extension member connected to a gun.

Referring now to FIGS. 13 and 14, it is contemplated that guns having mounting rails may have supplemental components, such as a scope, attached to the mounting rails which may prevent the mounting rails from engaging with the clamping unit 12. Therefore, one aspect of the invention includes an extension member 100 which may be connected to the gun and the clamping unit 12 to allow the supplemental components to remain on the mounting rail while the gun is cleaned. The extension member 100 includes an attachment rail 102 sized and configured to be engageable with the clamping unit 12 and a connecting portion 104 sized and configured to be engageable with the gun. The attachment rail 102 may define a shape that is similar to the mounting rail on the gun and complimentary to the mounting groove 22 on the clamping unit 12. The connecting portion 104 is preferably engaged with the end portion of the gun opposite the barrel to allow the gun to extend between the clamping unit 12 and barrel support 14 when the extension member 100 is connected to the clamping unit 12 and the gun (See FIG. 14).

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A gun mounting kit for securely mounting a gun to clean the gun, the gun having a Picatinny-style rail, the gun mounting kit comprising: a first clamp body having a first engagement surface; and a second clamp body attached to the first clamp body, the second clamp body having a second engagement surface, the first and second engagement surfaces collectively defining a mounting groove sized to be cooperatively engageable with the Picatinny-style rail, the second clamp body being moveable relative to the first clamp body between a clamping position and a release position, the first engagement surface moving away from the second engagement surface as the first clamp body moves from the clamping position toward the release position, wherein the first clamp body and second clamp body collectively define a clamping unit, the gun mounting kit further comprising a clamping handle coupled to the clamping unit, the clamping handle being moveable relative to the clamping unit between a handle clamp position and a handle release position, the clamping handle being configured to urge the second clamp body from the clamping position toward the release position as the clamping handle moves from the handle clamp position toward the handle release position, wherein the first clamp body includes a handle engagement surface, the clamping handle being pivotable about a handle pivot axis, the clamping handle having a cam configured to alter the distance between the handle pivot axis and the handle engagement surface as the clamping handle pivots between the handle clamp position and the handle release position.

2. The gun mounting kit recited in claim 1, wherein the gun mounting kit further comprising a barrel support disposable in spaced relation to the clamping unit, the barrel support being configured to be engageable with a barrel of the gun.

3. The gun mounting kit recited in claim 2, wherein the barrel support includes an arcuate barrel engagement surface sized and configured to engage with the barrel of the gun.

4. The gun mounting kit recited in claim 1, wherein the second clamp body is pivotally mounted to the first clamp body and is pivotable between the clamping position and the release position.

5. The gun mounting kit recited in claim 4, wherein the first clamp body defines a first arcuate pivot surface and the second clamp body defines a second arcuate pivot surface complimentary to the first arcuate pivot surface to allow the second clamp member to pivot relative to the first clamp member.

6. The gun mounting kit recited in claim 5, wherein the first arcuate pivot surface defines a concave shape and the second arcuate pivot surface defines a convex shape.

7. The gun mounting kit recited in claim 1, further comprising a spring engaged with the first clamp body and the second clamp body, the spring being configured to urge the second clamp body toward the release position.

8. A gun mounting kit for securely mounting a gun to clean the gun, the gun having an attachment rail, the gun mounting kit comprising: a first clamp body having a first engagement surface; and a second clamp body attached to the first clamp body, the second clamp body having a second engagement surface, the first and second engagement surfaces collectively defining a mounting groove sized to be cooperatively engageable with the attachment rail, the second clamp body being moveable relative to the first clamp body between a clamping position and a release position, the first engagement surface moving away from the second engagement surface as the first clamp body moves from the clamping position toward the release position, wherein the first clamp body and second clamp body collectively define a clamping unit, the gun mounting kit further comprising a clamping handle coupled to the clamping unit, the clamping handle being moveable relative to the clamping unit between a handle clamp position and a handle release position, the clamping handle being configured to urge the second clamp body from the clamping position toward the release position as the clamping handle moves from the handle clamp position toward the handle release position, wherein the first clamp body includes a handle engagement surface, the clamping handle being pivotable about a handle pivot axis, the clamping handle having a cam configured to alter the distance between the handle pivot axis and the handle engagement surface as the clamping handle pivots between the handle clamp position and the handle release position.

9. The gun mounting kit recited in claim 8, wherein the gun mounting kit further comprising a barrel support disposable in spaced relation to the clamping unit, the barrel support being configured to be engageable with a barrel of the gun.

10. The gun mounting kit recited in claim 8, wherein the second clamp body is pivotally mounted to the first clamp body and is pivotable between the clamping position and the release position.

11. The gun mounting kit recited in claim 10, wherein the first clamp body defines a first arcuate pivot surface and the second clamp body defines a second arcuate pivot surface complimentary to the first arcuate pivot surface to allow the second clamp member to pivot relative to the first clamp member.

12. The gun mounting kit recited in claim 11, wherein the first arcuate pivot surface defines a concave shape and the second arcuate pivot surface defines a convex shape.

13. The gun mounting kit recited in claim 8, further comprising a spring engaged with the first clamp body and the second clamp body, the spring being configured to urge the second clamp body toward the release position.

14. The gun mounting kit recited in claim 8, further comprising an extension member including a connecting portion and an attachment rail, the connecting portion being sized and configured to be engageable with the gun and the attachment rail being cooperatively engageable with the mounting groove.

* * * * *